United States Patent [19]

Spence, Jr.

[11] Patent Number: 4,838,724

[45] Date of Patent: Jun. 13, 1989

[54] BINDER WITH PENCIL POCKET

[75] Inventor: Meredith Spence, Jr., Dayton, Ohio

[73] Assignee: The Mead Corporation, Dayton, Ohio

[21] Appl. No.: 162,436

[22] Filed: Mar. 1, 1988

[51] Int. Cl.[4] ..... B42F 13/00; B42D 3/00; B65D 65/02; A41H 37/06

[52] U.S. Cl. ..... 402/79; 281/31; 150/154; 29/766

[58] Field of Search ..... 402/79; 281/29, 30, 281/17, 31, 35; 428/131; 40/122, 159, 359, 360; 206/450, 451, 810; 150/52 B; 29/766

[56] References Cited

U.S. PATENT DOCUMENTS

| | | | |
|---|---|---|---|
| 1,489,796 | 4/1924 | Stoughton . | |
| 1,524,647 | 2/1925 | Allrecht . | |
| 2,105,232 | 1/1938 | Schade | 281/31 |
| 2,280,889 | 4/1942 | Buxton | 150/39 |
| 2,318,192 | 5/1943 | Boelema | 281/31 |
| 2,677,376 | 5/1954 | Brunner | 129/1 |
| 2,801,115 | 7/1957 | Federbush et al. | 289/31 |
| 3,048,424 | 8/1962 | Mitchell | 281/31 |
| 3,267,841 | 8/1966 | Metcalf | 281/31 |
| 4,286,641 | 9/1981 | Watson | 281/31 |
| 4,307,499 | 12/1981 | Isella | 29/766 |
| 4,555,018 | 11/1985 | Cho | 206/214 |
| 4,605,245 | 8/1986 | Weaver | 281/31 |
| 4,630,843 | 12/1986 | Willet | 281/30 |
| 4,722,628 | 2/1988 | Rager | 281/29 |

*Primary Examiner*—Frank T. Yost
*Assistant Examiner*—Paul M. Heyrana, Sr.
*Attorney, Agent, or Firm*—Biebel, French & Nauman

[57] ABSTRACT

A pencil storage pocket for a binder is formed as an integral extension of a plastic covering of at least one cover of the binder by extending the plastic cover to define a flap which extends beyond the cover. A second plastic sheet substantially the same size as the flap is secured thereto along three sides to form a second wall of the pencil pocket, with the fourth wall being releasably secured by means of a pressure lock zipper to define a reclosable entryway for the pencil pocket. The base of the flap serves as a hinged mounting for the pencil pocket such that it can be selectively placed within the binder. The flap preferably extends from the outer end of a panel defining the binder cover such that the pocket is positioned adjacent the outer end of the panel. In this way, the pocket, which preferably extends approximately 40–50% of the width of the cover, and its contents are retained along approximately the outer half of the cover where there tends to be more room for storage.

7 Claims, 2 Drawing Sheets

BINDER WITH PENCIL POCKET

BACKGROUND OF THE INVENTION

The present invention relates generally to portfolios, binders and the like, and more particularly, to such a device including a pencil pocket incorporated thereinto.

The difficulty of carrying or storing pencils, pens and other school/business accessories in a portfolio, ring binder or the like has been recognized for many years. The terms "portfolio" and "binder" may be used interchangeably herein with the understanding that "binder" refers generically to hinged folders whether or not binder rings are provided. One solution to the storage problem is disclosed in U.S. Pat. No. 1,524,647, wherein pockets are formed on the inside surfaces of covers of a binder by means of extensions of the covers which are folded inwardedly and secured to the covers.

Another approach is disclosed in U.S. Pat. No. 2,318,192, wherein the covers of a loose-leaf ring binder are expanded to define compartments for holding pens, pencils, other accessories and even paper for use in the ring binder.

A more current and common approach to storage problems is disclosed in U.S. Pat. No. 2,677,376, wherein a plastic pocket is formed to define a closure along one edge and holes along the opposite edge such that the pocket can be secured within a ring binder by engaging the holes with the rings.

Unfortunately in each of the known storage arrangements, it is all too easy for articles to become dislodged from the pockets or the pockets themselves to become dislodged from the ring binder. Further, in each of the known storage arrangements for a binder, the stored items tend to be evenly distributed from the hinged portion of the binder to the outer edge of its covers, or may tend to accumulate toward the hinged portion of the binder as in the case of the pocket of U.S. Pat. No. 2,677,376. When the stored materials either evenly or in an accumulated mass occupy the hinged base portion of the binder, the materials tend to interfere with either the rings, if provided, or remaining materials which also tend to accumulate at the hinged base portion of the binder.

It is thus apparent that the need exists for an improved pencil pocket for a binder or the like which provides for the secure storage of pencils, pens and other accessories with little likelihood of loss from the pocket or indeed loss of the pocket, and which positions the storage pocket adjacent the outer ends of the covers of a binder where space is more typically available for such storage.

SUMMARY OF THE INVENTION

The problems associated with the prior storage arrangements are overcome in accordance with the present invention by forming a pencil pocket for a binder or the like as an integral extension of the covering of at least one cover of the binder.

A plastic cover overlaying the outer surface of a relatively stiff panel defining at least one of the covers of a binder is extended to define a flap which extends beyond the cover. Wall means is secured to the flap along three sides to form a second wall of a pencil pocket with the fourth wall being releaseably secured by means of fastener means to define a recloseable entryway for the pencil pocket. The base of the flap serves as a hinged mounting for the pencil pocket such that the pencil pocket can be selectively placed within the binder.

Preferably the flap extends from the outer end of the panel defining the binder cover such that the pencil pocket is positioned adjacent the outer end of the panel. In this way the pocket, which preferably extends approximately 40-50% of the width of the cover, and its contents are retained along approximately the outer half of the cover. In this area, there tends to be more room for storage with less competition from other materials which tend to accumulate towards the base of the binder.

To facilitate rapid identification and retrieval of items stored within the pocket, preferably the plastic cover and wall means are formed from a transparent plastic material. To further facilitate the use of the pencil pocket, preferably the fastener means comprises a pressure lock zipper with the pressure lock zipper being positioned toward the side of the flap adjacent to the relatively stiff panel forming a cover of the binder. With this positioning of the fastener means, if the pencil pocket is moved into the binder, the entryway is not only secured by means of a fastener, such as a pressure lock zipper, but that fastener is also folded inwardly and extends along the inner side of the fold between the pocket and the cover.

Further, if the fastener is a pressure lock zipper, it will tend to be closed by closing the binder and can be completely closed by applying force to the zipper against the panel forming the cover. Even if the fastener remains open, any articles which may tend to gravitate through the entryway of the pocket will be caught by the hinged fold connecting the pocket to the cover. If the binder is carried such that the pencil pocket moves out of the binder, the forces tending to move the pocket out of the binder similiarly tend to move the materials contained therein to the bottom of the pocket, and hence, away from the entryway. Also since the pencil pocket is an integral part of the binder, it is impossible for the pocket to fall from the binder with which it is associated.

It is a primary object of the present invention to provide a binder structure incorporating an integral pencil pocket which is conveniently and inexpensively formed during the assembly of the binder, which pencil pocket provides secure storage of pencils, pens and other accessories adjacent the outer end of at least one cover of the binder.

Other objects and advantages of the invention will be apparent from the following description, the accompanying drawings and the appended claims.

DETAILED DESCRIPTION OF THE INVENTION

Figure 2:
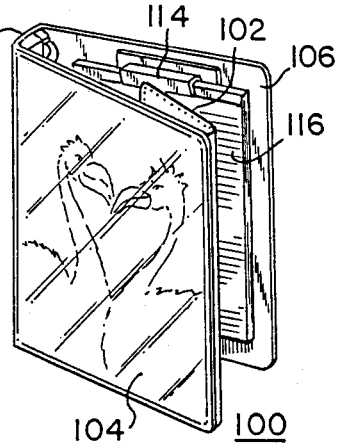
FIGS. 1 and 2 are perspective views of a binder including a pencil pocket in accordance with the present invention.
Figure 1:
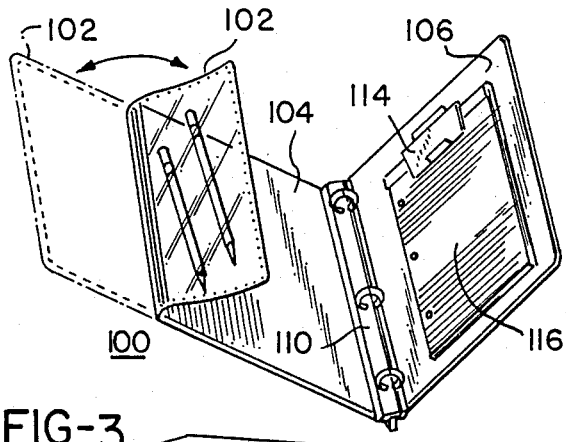
Figure 3:
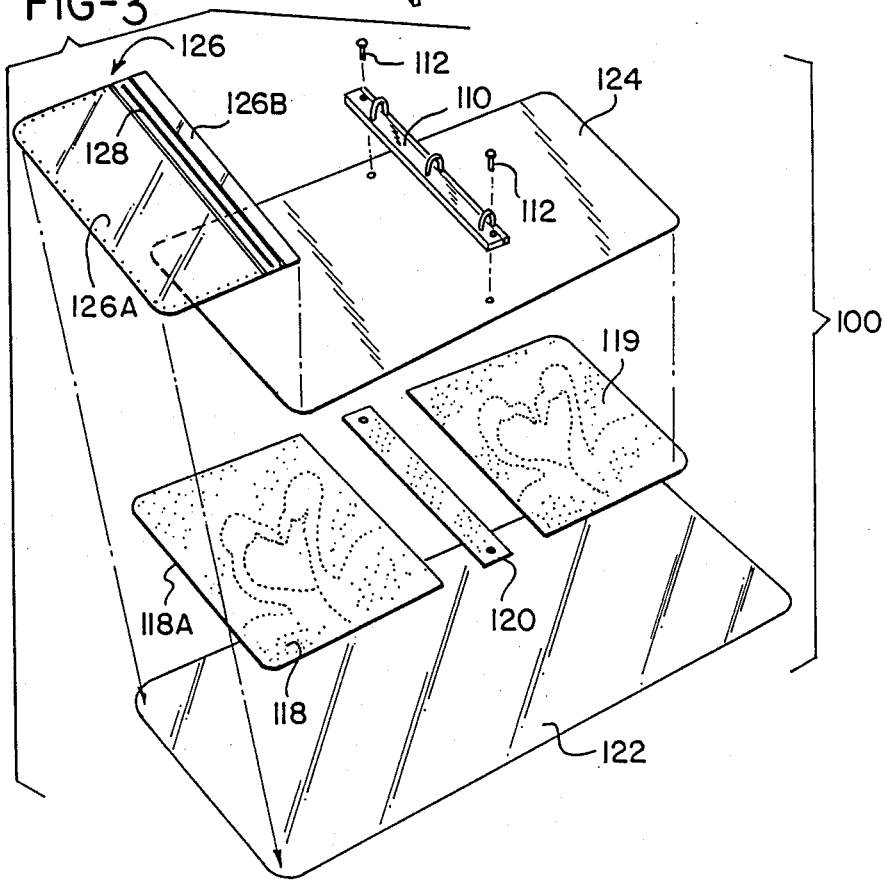
FIG. 3 is an exploded view of the components forming the binder of FIGS. 1 and 2.
Figure 4:
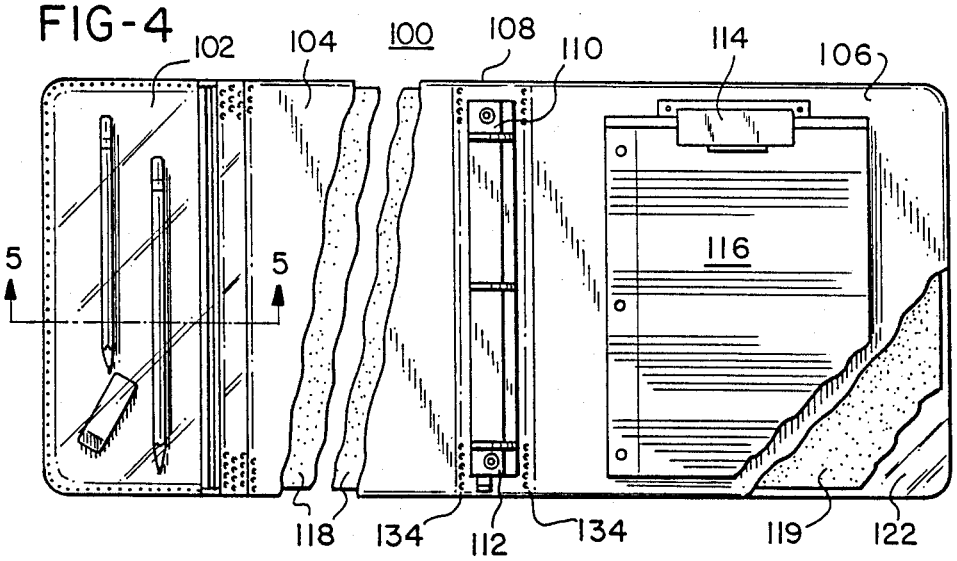
FIG. 4 is a partially broken away plan view of the binder of FIGS. 1 and 2 in its fully opened position.
Figure 5:
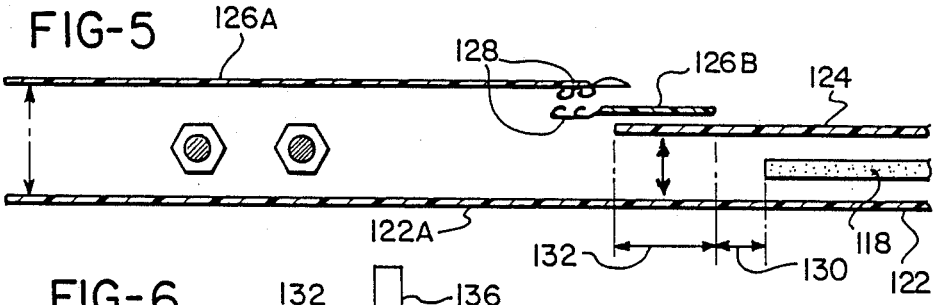
FIG. 5 is an exploded view showing the components which are used to form the pencil pocket as would be seen along the view line 5 in FIG. 4.

FIGS. 1 and 2 are perspective views of a binder 100 including a pencil pocket 102 in accordance with the present invention. Reference should be made to FIGS. 3 and 4 relative to the structure of the binder 100 and to FIGS. 3, 5, 6 and 7 relative to the structure of the pencil pocket 102. The binder 100 comprises a front cover 104 and a rear cover 106 which, in the illustrative embodiment, are hingedly connected to a center binder back strip 108 upon which is mounted a conventional loose-leaf binding device 110 by means of rivets 112 or other appropriate connectors. A clip 114 for holding a pad of notebook paper 116 or the like may be secured to the rear cover 106.

In the illustrated embodiment, the front and rear covers 104, 106 comprise relatively stiff panels 118, 119 while the center binder back strip 108 comprises a much narrower panel 120. All of the panels 118, 119, 120 can be formed from chipboard, cardboard or other appropriate material.

As best shown in FIG. 3, a plastic cover 122 overlays the outer surface of the panels 118, 119 and 120. The outer plastic cover 122 extends beyond the distal end 118A of the panel 118 to define a flap 122A which forms a first wall of the pencil pocket 102. Preferably, the plastic cover 122 including the flap 122A is transparent. By making the plastic cover 122 overlying the outer surface of the panels 118, 119 and 120 transparent, the appearance of the binder 100 can easily be varied by providing a variety of graphics on the outer surfaces of the panels 118, 119 and 120. Further, by making the outer plastic cover 122 including the flap 122A transparent, the pencil pocket formed in part by the flap 122A is transparent which facilitates rapid identification and retrieval of items stored within the pocket 102.

A second plastic cover 124 overlays the inner surface of the panels 118, 119 and 120, with the outer plastic cover 122 and inner plastic cover 124 being welded together around the top, bottom and right edges of the panels 118, 119 and 120 in a conventional manner. The inner plastic cover 124 is preferably formed of an opaque plastic material which provides a complimentary color background for the graphics provided on the outer surfaces of the panels 118, 119 and 120.

Wall means comprising a plastic material sheet 126 in the illustrated embodiment is substantially the same size as the flap 122A. The sheet 126 is secured to the flap 122A along three sides thereof in a conventional manner to form a second wall of the pencil pocket 102. In the preferred embodiment, the three sides of the sheet 126 which are secured to the flap 122A correspond to the free end of the flap 122A and the upper and lower edge of the flap 122A, while the fourth side of the sheet 126 corresponds to the edge of the flap 122A which is contiguous with and joins it to the plastic cover 122.

The sheet 126 comprises an outer section 126A and an inner section 126B. Fastener means, taking the form of a pressure lock zipper 128 in the illustrated embodiment, releasably secure the outer wall section 126A and the inner wall section 126B. The pressure lock zipper 128 is commercially available under the trademark FLEXTITE which is a registered trademark of Minigrip, Inc. of Orangeburg, N.Y. Since the inner edge of the inner wall section 126B is secured to the flap 122A, the pressure lock zipper 128 provides for releasably securing the outer section 126A of the wall means to the flap 122A along the fourth side which is the side of the flap 122A contiguous with the plastic cover 122. Thus, the pressure lock zipper 128 defines a reclosable entryway for the pencil pocket 102 defined by the flap 122A and the plastic sheet 126.

It is noted that the inner plastic cover 124 is inserted between the inner section 126B of the plastic sheet 126 prior to securing the inner section 126B to the flap 122A and the inner and outer plastic covers 124 and 122 at the distal end 118A of the front panel 118. Preferably, this bonding is performed by the Duraseal (Registered trademark of Raychem Corporation, Menlo Park, Calif.) process wherein the plastic materials are bonded to one another by means of a series of interleaved offset square bond areas as will be apparent to those skilled in the art. It is noted that one row of Durqseal bonds are formed between the inner plastic cover 124 and the outer plastic cover 122 in the area indicated by the numeral 130 in FIGS. 5 and 6 to form a hinge area for the pocket 102. The inner section 126B of the plastic sheet 126 is secured to the inner plastic cover 124 and the flap 122A by means of three rows of Duraseal bonds in the area defined by the numeral 132 to form a reinforced base section for the pocket 102 of the binder 100. Hinge sections are similarly formed at 134 where the front cover 104 and the rear cover 106 are connected to the back section 108 by a single row of Duraseal bonds.

Figure 6:
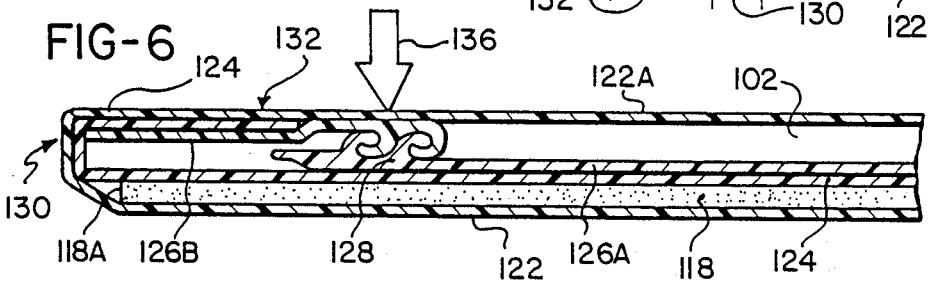
FIG. 6 is a sectional view showing the preferred method of closing the pencil pocket of a binder in accordance with the present invention.
Figure 7:
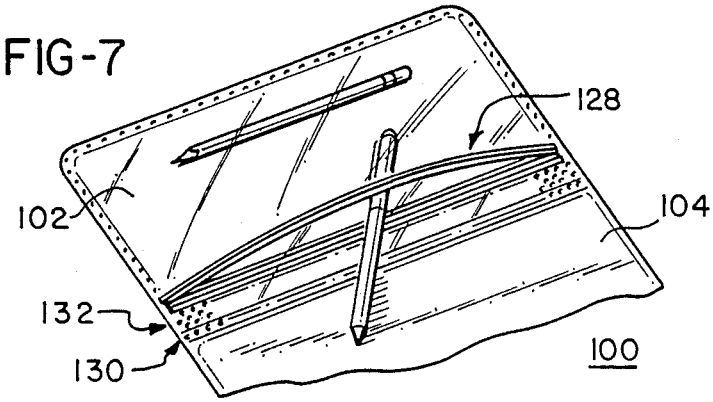
FIG. 7 is a perspective view showing an open entryway into a pencil pocket with a pencil extending therethrough.

As best shown in FIG. 6, when the fastener means of the pocket 102 takes the form of the pressure lock zipper 128, the pocket 102 can be conveniently closed by folding the pocket 102 into the binder 100 and applying pressure over the pressure lock zipper 128 and against the stiff panel 118 forming the front cover 104. This operation is indicated by an arrow 136 in FIG. 6. FIG. 7 shows the pressure lock zipper 128 opened to open the entryway into the pocket 102 with a pencil extending through the entryway.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A binder comprising front and rear hingedly connected covers wherein at least one of said covers comprises:

a relatively stiff panel;

a plastic cover overlaying the outer surface of said panel and extending beyond one edge thereof to define a flap which forms a first wall of a pencil pocket;

wall means secured to said flap along three sides thereof for forming a second wall of said pencil pocket; and fastener means for releaseably securing said wall means to said flap along a fourth side thereof to define a recloseable entryway for said pencil pocket.

2. A binder as claimed in claim 1 wherein said flap hingedly mounts said pencil pocket for selective placement within said binder.

3. A binder as claimed in claim 2 wherein said flap extends beyond the outer end of said panel to retain said pencil pocket adjacent said outer end.

4. A binder as claimed in claim 3 wherein said fastener means comprises a pressure lock zipper.

5. A binder as claimed in claim 4 wherein said fastener means is positioned in the side of said flap adjacent said panel.

6. A binder as claimed in claim 5 wherein said pencil pocket is sized to extend approximately 40–50% of the width of said at least one of said covers.

7. A binder as claimed in claim 6 wherein said plastic cover and said wall means are transparent.

* * * * *

UNITED STATES PATENT AND TRADEMARK OFFICE

CERTIFICATE OF CORRECTION

PATENT NO. : 4,838,724

DATED : June 13, 1989

INVENTOR(S) : Meredith Spence, Jr.

It is certified that error appears in the above-identified patent and that said Letters Patent is hereby corrected as shown below:

On the cover page under "References Cited", add:

FOREIGN PATENT DOCUMENTS

| | | | |
|---|---|---|---|
| 2,558,415 | 7/1985 | France | 281/31 |
| 3,032,346 | 3/1982 | Germany | 150/52B |

Signed and Sealed this

Seventeenth Day of April, 1990

*Attest:*

HARRY F. MANBECK, JR.

*Attesting Officer*

*Commissioner of Patents and Trademarks*